United States Patent [19]

Bajorek et al.

[11] 4,038,802

[45] Aug. 2, 1977

[54] TUBULAR SPINDLE COVER

[75] Inventors: Jay E. Bajorek, Wadsworth; Albert L. Newman, Cleveland Heights, both of Ohio

[73] Assignee: Questor Corporation, Toledo, Ohio

[21] Appl. No.: 687,320

[22] Filed: May 17, 1976

[51] Int. Cl.[2] ..... E04C 3/30; B44F 7/00

[52] U.S. Cl. ..... 52/731; 52/728; 52/311; 256/65; 256/22

[58] Field of Search ..... 52/731, 727, 728, 311, 52/585, 309; 256/21, 22, 24, 59, 65

[56] References Cited

U.S. PATENT DOCUMENTS

| | | | |
|---|---|---|---|
| 1,947,388 | 2/1934 | Frey | 52/728 |
| 2,808,233 | 10/1957 | Spescha | 256/22 |
| 3,113,760 | 12/1963 | Huret et al. | 256/21 |
| 3,200,554 | 8/1965 | Goodman et al. | 52/727 |
| 3,438,164 | 4/1969 | Duepree | 52/585 |
| 3,472,489 | 10/1969 | Baylin | 256/22 |
| 3,485,006 | 12/1969 | De Rozario | 256/65 |
| 3,498,589 | 3/1970 | Murdock | 256/21 |
| 3,804,374 | 4/1974 | Thom | 256/59 |

*Primary Examiner*—Price C. Faw, Jr.
*Assistant Examiner*—Robert C. Farber
*Attorney, Agent, or Firm*—Harry O. Ernsberger

[57] ABSTRACT

The disclosure embraces a tubular article or cover adapted to enclose a bar, spindle or baluster comprising longitudinal mating sections in combination with support members adapted to be secured or locked onto a bar, spindle or baluster and the mating sections mounted on the support members by interlocking the mating sections together.

8 Claims, 9 Drawing Figures

TUBULAR SPINDLE COVER

The invention relate to a tubular article, such as a tubular cover construction or jacket for a bar, spindle or baluster, comprising hollow mating sections which are interlocked or snapped together in assembly to enclose or cover the bar, spindle or baluster.

Architectural railing and spindle or baluster structures found in most residential and commercial railing installations are usually fashioned with spindles or balusters as bars, rods or like members made of metal such as wrought iron, steel or the like and are utilized in environments where the spindles or balusters are exposed to weather conditions or in an environment where the spindles or balusters may be easily scratched or damaged.

Spindles or balusters usually have a decorative finish such as by applying paint or other coating. The decorative surfaces in use may be easily scratched or worn by physical contact and, where the spindles or balusters are subjected to weather conditions, the surfaces may be deteriorated, marred or impaired by oxidation or chemical action, thus detracting from the desired aesthetic or decorative effect.

The invention embraces the provision of a tubular article, such as a cover or sheath, fashioned of mating sections for covering or enclosing a spindle or baluster in association with support or locking means mounted by a spindle or baluster for mounting or supporting the mating sections of the tubular article in assembled relation.

An object of the invention is the provision of a cover or enclosure for a spindle or baluster fashioned of mating sections and includes support means adapted to be locked or secured on a spindle or baluster, the mating sections of the cover or enclosure embracing the support means, and the mating sections configurated in a manner whereby interlocking of the mating sections in assembly enclosing the support means effects snug engagement of the mating sections with the support means.

Another object of the invention is the provision of a tubular article or enclosure for a spindle or baluster wherein the tubular article or enclosure is fashioned of interlockable hollow mating sections formed of resinous or plastic composition or aluminum in association with support means secured or locked on the spindle or baluster and providing mounting means engaged by the mating sections in assembled or interlocked relation to provide an enclosure or cover for the spindle or baluster.

Another object of the invention resides in a cover or enclosure for a spindle or baluster comprising interlockable hollow mating sections in association with mounting means affixed to or locked on the spindle or baluster wherein the mounting means is adjustable for engagement with spindles or balusters of various cross sectional configurations whereby the assembled sections of the cover or enclosure engage and are supported on the mounting means.

Another object of the invention resides in a cover, sheath or sleeve for a spindle, the cover, sheath or sleeve being fashioned of hollow mating sections in association with mounting means adapted to be mounted upon a spindle, the mounting means comprising interlocking members for engagement with a spindle, the assembled interlocking members on a spindle providing a mounting structure engaged by the mating sections of the cover, sheath or sleeve for retaining the same against relative movement after its assembly on a spindle.

Another object of the invention resides in the provision of mounting means for a spindle cover wherein the mounting means comprises interlocking members adapted to be assembled on a spindle and adjusted to accommodate spindles of various cross sections, the members in interlocked assembled relation on a spindle providing a mounting for receiving mating sections of a spindle cover whereby the cover sections in assembly snugly engage the interlocked members to mount and stabilize the cover against relative movement.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which.

Figure 1:
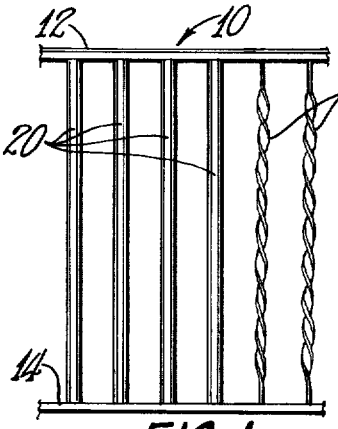
FIG. 1 is a fragmentary elevational view of a railing and spindle construction illustrating uncovered spindles and spindle covers of the invention.

The spindle cover construction illustrated in the drawings is generally rectangular in cross section but it is to be understood that the cover construction may be of a different cross sectional configuration if desired.

Referring to the drawings and initially to FIG. 1, there is shown a portion of a railing and spindle or baluster construction 10 with certain of the spindles enclosed or jacketed by the cover construction of the invention. The construction shown in FIG. 1 includes an upper railing 12 and a lower railing 14 with vertically disposed spindles or balusters 16 joined to the railings.

This arrangement of railings and spindles is of conventional construction, the railings usually being of metal such as wrought iron or steel. The spindles 16 are usually fashioned of wrought iron or steel and, as illustrated in FIG. 1, the spindles 16 are of flat or rectangular cross section of spiral configuration lengthwise of the spindle but they may be of square or polygonal cross sections. FIG. 1 illustrates spindle cover constructions 20 of the invention enclosing spindles of the character illustrated at 16.

The cover 20 of the invention comprises two substantially identical mating sections 22 and 24 which, in assembled or mating relation, provide a tubular or hollow article or cover adapted to enclose a spindle or baluster such as the spindle or baluster 16. The cover sections 22 and 24 are preferably fashioned of moldable material such as resinous or plastic composition or may be of metal such as aluminum. Several resinous or plastic compositions may be used such as acrylonitrile-butadiene-styrene, polyvinyl chloride, talcfilled polypropylene or other suitable material.

Figure 4:
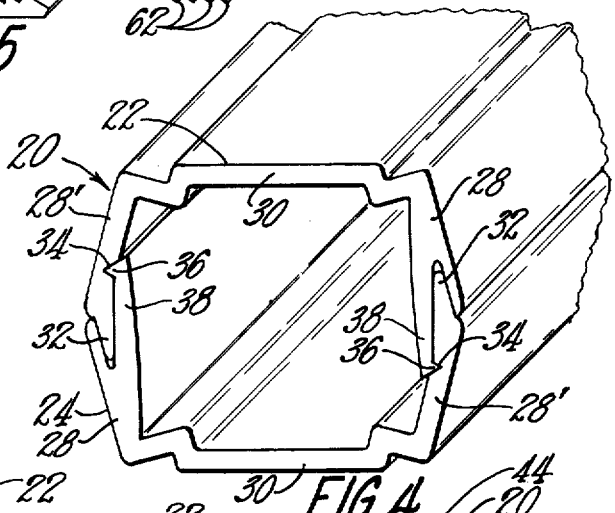
FIG. 4 is an enlarged end view of the spindle cover shown in FIGS. 2 and 3.
Figure 2:
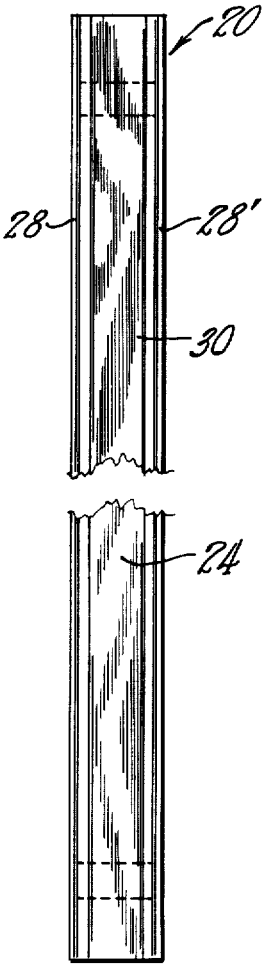
FIG. 2 is a front elevational view of a spindle cover of the invention.
Figure 3:
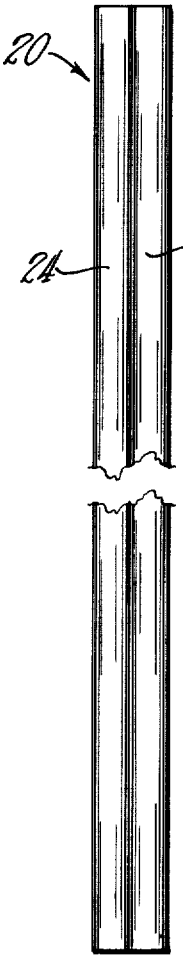
FIG. 3 is a side elevational view of the spindle cover shown in FIG. 2.

As illustrated in FIG. 4, the mating sections 22 and 24 in assembly provide a tubular article or hollow cover of substantially rectangular cross sectional configuration. The sections, components or members 22 and 24 are generally U-shaped or channel-shaped and, in assembly, have overlapping regions or portions configurated whereby the sections are snapped together or interlocked as shown in FIG. 4.

Each section 22 and 24 is fashioned with side wall portions or sides 28 and 28' joined by a generally planar portion 30. Each of the side wall portions 28 is fashioned with a longitudinal V-shaped groove adapted to receive and accommodate a tapered projection 32 on each of the side walls 28' as shown in FIG. 4. Each of the side wall portions 28' is fashioned on its interior surface with a longitudinal groove or recess 34 adapted to receive or accommodate a longitudinally extending ridge or projection 36 formed on a portion 38 of each side wall 28, the portions 38 overlapping portions of the side walls 28' when the sections 22 and 24 are in mating engagement.

In assembly, when the mating sections are brought together in mating relation by manual squeeze pressure, the projections 32 extend into the V-shaped grooves in the side wall portions 28 and the longitudinal ridges or projections 36 interlock or engage in the recesses 34.

The side walls or wall portions 28 and 28' of the sections are sufficiently flexible so that when manual squeeze pressure is applied or exerted on the sections to bring them into engaging relation, the portions 38 are flexed sufficiently to enable the snap interlocking or engaging relation of the ridges or projections 36 in the recesses 34 to hold the sections in assembled relation. In this manner the mating sections 22 and 24 form a tubular article, cover or jacket for enclosing a spindle or baluster.

The invention includes mounting means or arrangements for installation on a spindle or baluster adapted to be engaged by the cover sections 22 and 24 for mounting or supporting the cover construction 20 and stabilizing the cover to prevent rotation of the cover with respect to the enclosed spindle. The cover mounting, support means or arrangement 40, also referred to herein as a sleeve lock, comprises two components, members or elements which are adaptable for engagement with a spindle 16 or for engagement with a spindle of other cross section such as a spindle of square cross section.

Figure 5:
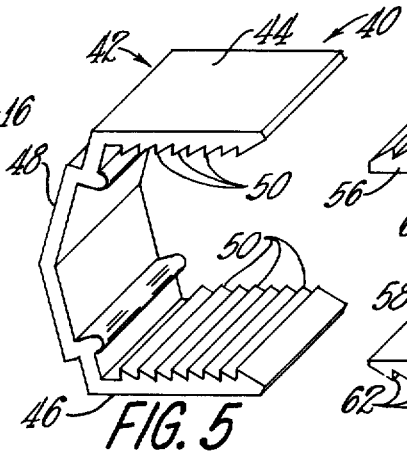
FIG. 5 is an isometric view of one member forming a component of a cover mounting means.
Figure 6:
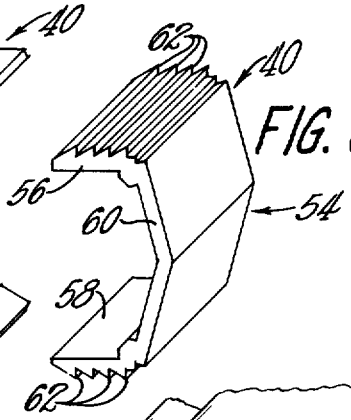
FIG. 6 is an isometric view of the other member forming a component of the cover mounting means.

The means for mounting the cover construction for enclosing the spindles is illustrated in FIGS. 5 through 9. The components or members comprising the mounting, support means or sleeve lock for the cover are illustrated in FIGS. 5 and 6 and are shown in assembled relation with a spindle and with a cover in FIGS. 7 and 8.

FIG. 5 illustrates one of the components or members 42 of the mounting means 40. The member 42 is of U-shape or channel configuration having side walls 44 and 46 integrally joined by a connecting wall 48. The interior regions of the wall portions 44 and 46 are formed with lengthwise parallel serrations providing ridges or teeth 50.

The second component or member 54 of the cover mounting or supporting means 40 is illustrated in FIG. 6. The member 54 is of U-shape or channel configuration having side walls 56 and 58 joined by a connecting wall portion or wall 60. The exterior regions of the side walls 56 and 58 of the component or member 54 are fashioned with lengthwise parallel serrations providing ridges or teeth 62.

The components 42 and 54 may be formed of metal, such as aluminum, or may be of resinous or plastic compositions, such as acrylonitride-butadiene-styrene, polyvinyl chloride or talc-filled polypropylene, heretofore mentioned as materials for the mating sections 22 and 24 of the cover. The members 42 and 54 are fashioned with comparatively thin walls and are dimensioned so that when they are fitted onto a spindle, the teeth 50 and 62 of the side walls of the members are snapped into interlocking or engaging relation as shown in FIGS. 7 and 8.

Figure 7:
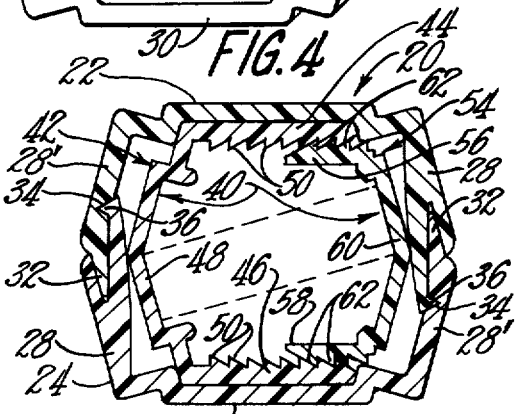
FIG. 7 is an enlarged sectional view illustrating the assembly of spindle cover construction and cover mounting means.
Figures 8, 9:
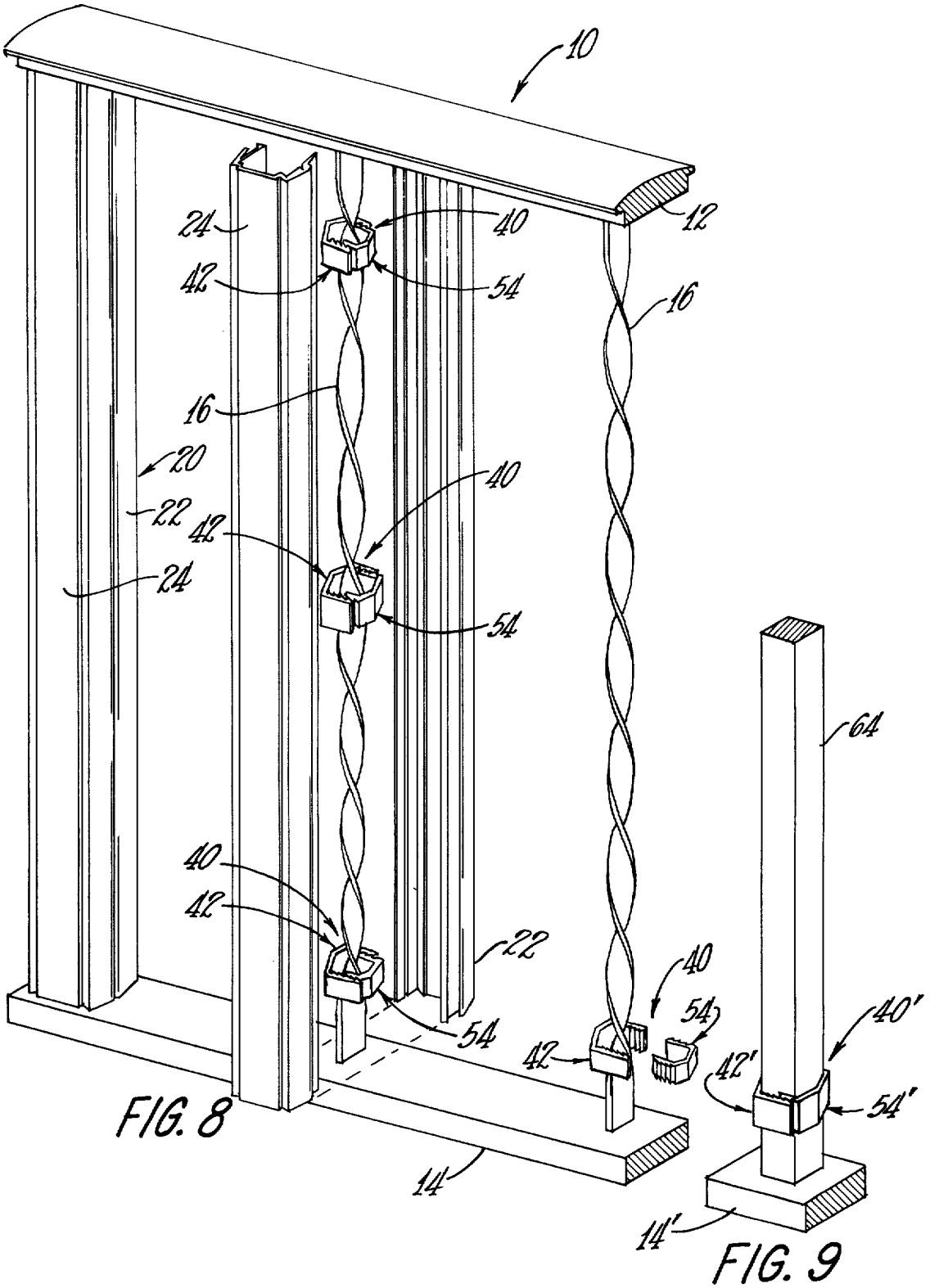
FIG. 8 is a composite isometric view illustrating the method of assembling the cover mounting means on a spiral spindle of rectangular cross section and the method of assembling the spindle cover sections on the mounting means.
FIG. 9 is an isometric view illustrating the method of assembling the spindle cover mounting means on a spindle of square cross section.

The material of the members 42 and 54 coupled with the comparatively thin walls of the members render the walls sufficiently flexible whereby under manual squeeze pressure, the teeth snap over one another providing adjustment of the members toward each other until the members engage and encompass a spindle 16 in the manner illustrated in FIGS. 7 and 8.

The method of assembling the sleeve locks or supporting means 40 and the mating sections 22 and 24 with a spindle or baluster or spiral configuration is illustrated in FIG. 8. As shown in FIG. 8, there are preferably three cover mounting means, supports or sleeve locks 40 assembled on the spirally configurated spindle 16, although a greater or lesser number of supporting means or sleeve locks 40 may be employed with each spindle depending upon the lengths of the spindles.

Illustrated adjacent the right-hand spindle 16 in FIG. 8 are the components or members 42 and 54 in spaced relation in a position to be moved toward each other for securing or interlocking the components or members on a spindle 16. The spindle 16 at the central region of FIG. 8 is equipped with the components 42 and 54 of each of the sleeve locks or support means 40 in interengaged or locking relation with the spindle 16.

FIG. 7 illustrates the teeth 50 of the component 42 interlocked or interengaged with the teeth 62 of the component 54, the components embracing the spindle 16 and in securing engagement with the spindle.

The central portion of FIG. 8 illustrates the mating sections 22 and 24 in position to be brought together into interlocking or snapped engagement, the left-hand portion of FIG. 8 illustrating the cover sections 22 and 24 in snapped-together assembled relation enclosing a spindle. FIG. 7 illustrates the mating sections 22 and 24 of the cover in interlocked relation and in engaged relation with the locking sleeves or mounting means 40. Through the provision of a substantial number of ridges or projections on the components 42 and 54, the components may accommodate spindles of varying dimensions.

FIG. 9 illustrates the application of the cover mounting means to a spindle 64 of substantially square cross section vertically disposed between upper and lower rails, the lower rail being indicated at 14'. Cover mounting means 40' is of the same construction as the mounting means 40 and includes component or member 42' and component or member 54', FIG. 9 illustrating one of the mounting means 40' with the components in interlocked or interengaging relation with the spindle 64.

While only one mounting means 40' is illustrated in FIG. 9, it is to be understood that more than one mounting means 40' are associated with the spindle 64. The interior contour of the mounting means or sleeve lock construction 40' is such that the square cross sectional configuration of the spindle 64 is readily accommodated within the mounting means components 42 and 54 in interengaged relation, and cover sections are engaged with the mounting means in the manner hereinbefore described.

The cover construction, in combination with the cover mounting means, is adapted for enclosing or covering spindles of various cross sectional configurations and may be applied or installed on a spindle or baluster without the use of special tools. The surface areas of the cover sections may be of a decorative motif or design to present a pleasing and aesthetic appearance. The cover construction requires no maintenance and is resistant to deterioration and physical damage.

Building code specifications usually require certain spacing distances between adjacent spindles. Recently, building codes in certain areas have been changed requiring reduced spacing between adjacent spindles. Through the application of the cover or sleeve constructions of the invention to spindle constructions previously installed and in use, the space between adjacent covers is less than the space between adjacent spindles. Thus, the installation of the cover constructions of the invention effects compliance with most regulations requiring lesser spacing.

Wrought iron or steel spindles of the character that have been in use many years are readily subject to oxidation and deterioration and require maintenance or repainting at frequent intervals. The spindle cover construction of the present invention avoids costly maintenance and the covers retain their original appearance for long periods of time.

It is apparent that, within the scope of the invention, modifications and different arrangements may be made other than as herein disclosed, and the present disclosure is illustrative merely, the invention comprehending all variations thereof.

We claim:

1. A tubular construction for enclosing a baluster including, in combination, mounting means on the baluster comprising pairs of interlockable elements spaced lengthwise of the baluster and in interlocked relation thereon, a pair of elongated channel-shaped mating hollow sections, said sections having recesses and ridges, the ridges and recesses being configurated for snapping interlocking engagement when the sections are assembled in mating relation, said sections in mating relation engaging and enclosing the interlocked elements and enclosing the baluster.

2. A tubular construction for enclosing a baluster including, in combination, mounting means on the baluster comprising pairs of interlockable elements spaced lengthwise of the baluster and in interlocked relation thereon, a pair of elongated channel-shaped mating sections, a side wall of each of the sections having groove means, the opposite side wall of each section having projecting means adapted to be received in the groove means, an interior region of each side wall provided with recess means, and a side wall of each section having ridge means arranged to be snapped into the recess means for securing the sections together in mating relation, said sections in mating relation engaging and enclosing the interlocked elements and enclosing the baluster.

3. The combination according to claim 2 wherein the mating sections are of resinous material.

4. The combination according to claim 2 wherein the mating sections are of resinous material selected from the group comprising acrylonitrile-butadiene-styrene, polyvinyl chloride and talc-filled polypropylene.

5. A tubular construction for enclosing a baluster including, in combination, mounting means on the baluster comprising pairs of interlockable elements spaced lengthwise of the baluster and in interlocked relation thereon, a pair of elongated substantially identical channel-shaped mating sections, a side wall of each of the sections having a lengthwise-extending V-shaped groove, the opposite side wall of each section having a lengthwise-extending V-shaped portion, the V-shaped portions adapted to be received in the V-shaped grooves, an interior region of each side wall having a lengthwise-extending recess, and a sidewall of each section provided with a projection having a lengthwise-extending ridge arranged to be snapped into a recess in the other section for securing the sections together in mating relation, said sections in mating relation engaging and enclosing the interlocked elements and enclosing the baluster.

6. A tubular construction for enclosing a baluster including, in combination, a pair of elongated mating hollow sections, each of said sections having edge configurations for interlocking engagement of the sections in mating relation enclosing a baluster, a plurality of mounting means engageable with the baluster for supporting the sections when in mating relation, each of said mounting means including pairs of interengageable elements adapted to embrace the baluster, the elements of each pair being adjustable one with respect to the other to fit into balusters of various cross sectional configurations, said mounting means being enclosed by and supporting the mating sections when the sections are in assembled relation.

7. A tubular construction for enclosing a baluster including, in combination, a pair of elongated mating hollow sections, each of said sections having longitudinal edge configurations for snapping interlocking engagement of the mating sections to enclose the baluster, a plurality of mounting means adapted for engagement with the baluster for supporting the mating hollow sections of the tubular construction, each of said mounting means comprising a pair of U-shaped elements having wall portions provided with serrations, each pair of said U-shaped elements in assembly having the serrated wall portions in overlapping relation adapted to embrace the baluster and the teeth provided by the serrations interengaged to secure the mounting means on the baluster, said mating sections embracing and engaging the plurality of mounting means when the sections are assembled in interlocked relation whereby the sections are supported by the mounting means.

8. The combination according to claim 7 wherein the U-shaped elements are of resinous material selected from the group comprising acrylonitrile-butadiene-styrene, polyvinyl chloride and talc-filled polypropylene.

* * * * *